US006005948A

United States Patent [19]

Maeda

[11] Patent Number: 6,005,948

[45] **Date of Patent: *Dec. 21, 1999**

[54] AUDIO CHANNEL MIXING

[75] Inventor: Shuichi Maeda, Chiba, Japan

[73] Assignees: Sony Corporation, Tokyo, Japan; Sony Electronics Inc., Park Ridge, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/828,263

[22] Filed: Mar. 21, 1997

[51] Int. Cl.[6] ..... H04R 5/00

[52] U.S. Cl. ..... 381/18; 381/119

[58] Field of Search ..... 381/18, 19, 20, 381/21, 22, 17, 119, 1

[56] References Cited

U.S. PATENT DOCUMENTS

| | | | |
|---|---|---|---|
| 3,944,735 | 3/1976 | Willcocks . | |
| 5,463,424 | 10/1995 | Dressler | 381/22 |
| 5,524,054 | 6/1996 | Spille | 381/20 |
| 5,594,800 | 1/1997 | Gerzon . | |
| 5,680,464 | 10/1997 | Iwamatsu | 381/18 |

FOREIGN PATENT DOCUMENTS 631 458 12/1994 European Pat. Off. .

757 506 5/1997 European Pat. Off. .

OTHER PUBLICATIONS

Todd et al., *AC–3: Flexible Perceptual Coding for Audio Transmission and Storage*, Dolby Technical Papers, Publication No. S94/10152, 1994.

Advanced Television Systems Committee Doc. A/52, *Digital Audio Compression Standard (AC–3)*, ATSC, Dec. 20, 1995.

*Primary Examiner*—Ping Lee

*Attorney, Agent, or Firm*—Wood, Herron & Evans, L.L.P.

[57] ABSTRACT

A multi-channel input signal is downmixed to a multi-channel output signal by one of four downmixing routines. The downmixing routines compute the output channels by multiplying each of a number of coefficients by one of the input channels, and then accumulating the resulting products to form the output channels. For efficiency, the four downmixing routines perform various different computations on the input channels using different combinations of coefficients. For a given combination of input and output channels, a downmixing routine is chosen that will perform all of the necessary computations for downmixing the input to the output, while minimizing the number of computations performed with zero-valued coefficients. As a result, computational efficiency is increased by avoiding unnecessary computations, while at the same time, programming effort and program size are maintained at reasonable levels.

22 Claims, 2 Drawing Sheets

AUDIO CHANNEL MIXING

FIELD OF THE INVENTION

The present invention relates to mixing multiple channels of input audio signals into the same or a different number of multiple channels of output audio signals.

BACKGROUND OF THE INVENTION

Since the first widespread introduction of home electronics, efforts have been made to make home entertainment systems closer to live entertainment, or to commercial movie theaters. Among other improvements, efforts have been made to increase the number of sound channels to enhance the home-theater experience to produce more enveloping and convincing sound reproduction. This trend has been accelerated in no small part by the advent of digital signal transmission and storage, which has widely increased the options and alternatives available.

A recent standard for digital audio is known as AC-3, promulgated by Dolby Laboratories and currently anticipated for wide use in connection with digital television and audio transmissions, as well as digital storage media. The AC-3 standard provides for delivery, from storage or broadcast, of up to six channels of audio information, specifically, left, right and center channels, as well as left surround, right surround, and low frequency effect channels. Further information on the AC-3 standard can be found in "Digital Audio Compression (AC-3) Standard", published by the United States Advanced Television Systems Committee, Dec. 20, 1995, and C. Topp et al., "AC-3: Flexible Perceptual Coding for Audio Transmission and Storage", AES $96^{th}$ Convention (February 1994).

Although the AC-3 standard allows for up to five channels of wideband audio information, plus a single channel of low frequency effects, in many cases a given audio program may include fewer than five wideband and one low frequency channel. For example, a typical older stereo program may include only left and right channels. The AC-3 standard provides for such situations by defining 8 different audio coding modes, known as "ac-modes" in which the five wideband channels may be stored or transmitted compatibly with the AC-3 standard. (In addition, the digitally stored or transmitted program may, or may not, further include a sixth low frequency channel.) The number and nature of the wideband channels provided by seven of the eight ac-modes, are described in the following table:

| ac-mode | channels | wideband channel descriptions |
|---|---|---|
| 1 | 1 | Center |
| 2 | 2 | Left, Right |
| 3 | 3 | Left, Center, Right |
| 4 | 3 | Left, Right, Surround |
| 5 | 4 | Left, Center, Right, Surround |
| 6 | 4 | Left, Right, Left Surround, Right Surround |
| 7 | 5 | Left, Center, Right, Left Surround, Right Surround |

In addition to the seven input modes identified in the preceding table, there is also an eighth audio coding mode, known as ac-mode0. When audio is received in ac-mode0, special output formats may be invoked, as discussed in detail below.

The number of channels that can be reproduced at a particular installation will vary. Because many sound systems are not equipped with a full complement of speakers capable of delivering the channels that may be encoded under AC-3, the channels provided by an AC-3 formatted signal must be "downmixed" for delivery via fewer than a full complement of speakers.

Specifically, when the input signal to an AC-3 compatible sound system uses one of ac-modes 1–7 identified by the above table, the output signal may be produced in one of eight output modes, known as "output_modes". The eight output_modes, and the number and nature of the channels produced under each mode, are described in the following table:

| output_mode | channels | channel descriptions |
|---|---|---|
| 2/0 | 2 | Left, Right |
| 1/0 | 1 | Center |
| 2/0 | 2 | Left, Right |
| 3/0 | 3 | Left, Center, Right |
| 2/1 | 3 | Left, Right, Surround |
| 3/1 | 4 | Left, Center, Right, Surround |
| 2/2 | 4 | Left, Right, Left Surround, Right Surround |
| 3/2 | 5 | Left, Center, Right, Left Surround, Right Surround |

In addition to these output modes, as noted above, special output modes are available when an input signal is delivered in ac-mode 0. Specifically, when the input is delivered in ac-mode 0, the output format is selected by identifying (a.) the number of front speakers (1, 2 or 3), whether the output should be in a stereo format (DUAL_STEREO), a monophonic format derived from the left channel (DUAL_LEFTMONO), a monophonic format derived from the right channel (DUAL_RIGHTMONO), or a monophonic format derived from a mixture of both stereo channels (DUAL_MIXMONO).

For each combination of an input mode (ac-mode value) and an output mode (output_mode value or, in the case of ac-mode 0, number of front speakers, and STEREO/MONO settings, as described above), the output channels are generated by collecting samples from the wideband input channels into a five-dimensional vector i, and premultiplying the vector i by a 5×5 downmixing matrix D, to form a resultant five-dimensional vector o containing the corresponding samples of the output channels. Specifically, the downmixing equation is:

$$o=D\cdot i$$

Where i is a five-dimensional vector formed of samples from the Left, Center, Right, Left Surround and Right Surround input channels, $i_L$, $i_C$, $i_R$, $i_{LS}$, $i_{RS}$, respectively:

$$i=\begin{bmatrix} i_L \\ i_C \\ i_R \\ i_{LS} \\ i_{RS} \end{bmatrix},$$

o is a five-dimensional vector formed of corresponding samples from the Left, Center, Right, Left Surround and Right Surround output channels, $O_L$, $O_C$, $O_R$, $O_{LS}$, $O_{RS}$, respectively:

$$o = \begin{bmatrix} o_L \\ o_C \\ o_R \\ o_{LS} \\ o_{RS} \end{bmatrix},$$

and D is a 5×5 matrix of downmixing coefficients:

$$D = \begin{bmatrix} d_{11} & d_{12} & d_{13} & d_{14} & d_{15} \\ d_{21} & d_{22} & d_{23} & d_{24} & d_{25} \\ d_{31} & d_{32} & d_{33} & d_{34} & d_{35} \\ d_{41} & d_{42} & d_{43} & d_{44} & d_{45} \\ d_{51} & d_{52} & d_{53} & d_{54} & d_{55} \end{bmatrix}.$$

The reader will appreciate that this matrix computation involves multiplying each of the coefficients $d_{**}$ in the downmixing matrix D by one of the input channel samples to form a product. These products are then accumulated to form samples of the output channels.

Various values of coefficients $d_{}$ in the downmixing matrix D are used for downmixing in each of the 71 possible combinations of input and output modes supported by AC-3. In some cases, the downmixing coefficients $d_{}$ are computed from parameters stored or broadcast with the AC-3 compliant digital audio data, or parameters input by the listener. The appendix to this application describes the values of the coefficients in downmixing matrix D, for each of the 71 permitted combinations of input and output modes, for reference.

SUMMARY OF THE INVENTION

The process of multiplying a 5×5 downmixing matrix by a 5-dimensional input vector to produce a 5-dimensional output vector is computationally intense. Specifically, such a computation requires 25 multiply-and-accumulate (MAC) operations. Since the downmixing operation must be performed for every sample in the audio signal (which are received at 32, 44.1 or 48 kHz, depending upon the sampling rate in use), this operation would require processing about 1.25 million MAC operations per second, which can be taxing on a processor, particularly if other operations (such as filtering, decompression, etc.) are to be performed simultaneously.

Reviewing the downmixing matrices identified in the appendix, it may be noted that despite the wide variety of coefficient arrangements in the various downmixing matrices, in each specific matrix, a sizeable number of the coefficients $d_{**}$ have values of 0. Accordingly, many of the MAC operations that would be performed in an approach such as described in the preceding paragraph, would involve a multiplication by zero, and therefore could be eliminated from the computation without any substantive change in result.

An alternative to the above approach, therefore, would be to prepare, for each of the 71 combinations of input and output modes supported under AC-3, a specialized computational routine which performs only those MAC operations in which the corresponding downmixing entries are non-zero. Such an approach would realize a substantial savings in processing time by avoiding any unnecessary MAC operations.

Unfortunately, this second approach would require custom programming of 71 computational routines, one for each supported combination of input and output modes. This would constitute a substantial programming effort as well as result in a relatively large program.

In accordance with principles of the present invention, a third approach is used in downmixing computation, one which achieves a substantial reduction in processing time as compared to the first approach described above, while only requiring custom programming of four separate software routines.

Specifically, in one aspect, the invention features a method for downmixing in which, as in the above-described approaches, downmixing is performed by generating a number of downmixing coefficients and multiplying each coefficient by one of the input channels, and then accumulating groups of the resulting products to form the output channels. However, the method is unlike either the full-calculation approach (as first described above) or a fully-custom approach (as second described above). Specifically, the method is distinguished from the full-calculation approach in that there is more than one downmixing routine, specifically, there are at least two such routines, which generate and perform calculations using different combinations of downmixing coefficients. The method is also distinguished from the fully-custom approach, in that at least in some cases, zero-valued coefficients are used by the downmixing routines.

In a specific disclosed embodiment, there are four such downmixing routines. For each of the 71 combinations of input and output channels specified under AC-3, one of these downmixing routines is selected and used in computing the output channels. Each of the downmixing routines computes the output channels using a subset of the coefficients of the downmixing matrix D; that is, for efficiency, each downmixing routine is written on the assumption that some of the coefficients in the matrix D are zero, and the corresponding computations are omitted from that downmixing routine. Different coefficients and computations are omitted by the various downmixing routines, so that for each combination of input and output channels, there is a downmixing routine that will at least include in its computations, all of the non-zero coefficients of the appropriate downmixing matrix D. In many input/output combinations, however, at least one zero-valued coefficient will be included in the computations made by the downmixing routine. Although this results in a minor loss in computational efficiency, this loss in efficiency is more than compensated by the substantial reduction in coding effort involved in writing four downmixing routines as compared to 71 custom routines, as well as the reduction in program size.

The first step of the inventive method is to generate the appropriate downmixing matrix D for the current input/output combination. The matrices and their manner of computation are identified in the appendix. As noted above, the coefficients of the downmixing routines are, in some cases, computed from parameters identified by the AC-3 compliant digital bit stream being downmixed, or alternatively (or in addition) from parameters identified by the listener. Accordingly, this step may also involve obtaining the appropriate parameters and using them to generate the downmixing matrix.

The second step of the inventive method is to select the appropriate downmixing routine, i.e., select the downmixing routine that will at least include in its computations, all of the non-zero coefficients of the generated downmixing matrix.

Finally, the selected downmixing routine is used to compute values for the output channels, which values can then be output.

The above and other aspects, objects and advantages of the present invention shall be made apparent from the accompanying drawings and the description thereof.

BRIEF DESCRIPTION OF THE DRAWING

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF SPECIFIC EMBODIMENTS

Figure 1:
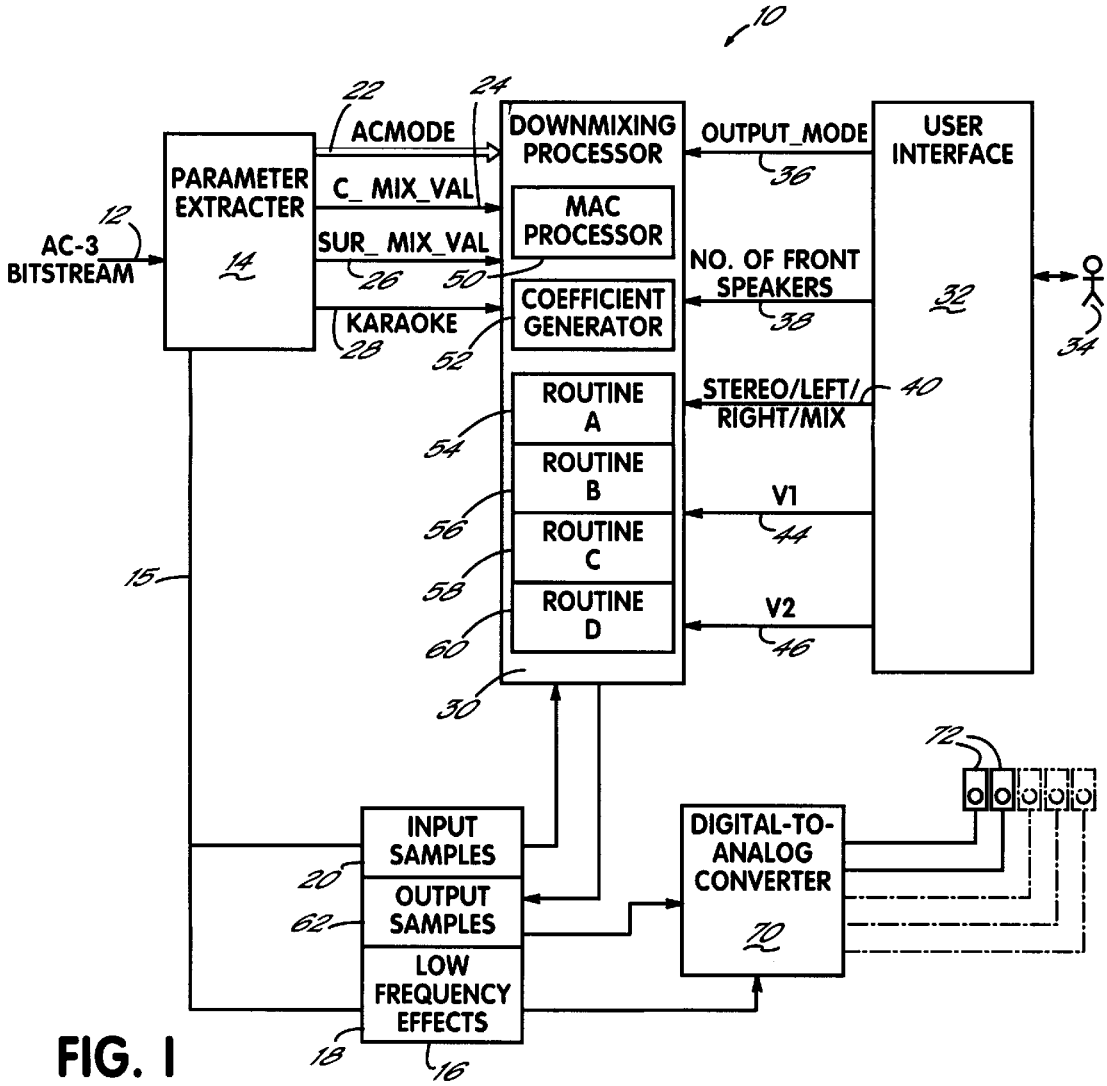
FIG. 1 a block diagram of a computing circuit for downmixing an AC-3 compatible bitstream to produce multiple output channels at the direction of a user.

Referring now to FIG. 1, an apparatus 10 for carrying out principles of the present invention includes various functional elements which process AC-3 encoded digital signals received on a digital input line 12. Typically, the AC-3 encoded digital signals are received in a serial format, as a bit stream. It will be assumed that such a format is received, although other formats could also be received in accordance with principles of the present invention.

The incoming bitstream on line 12 is first processed by a parameter extractor 14, a custom hardware element designed to parse an AC-3 formatted bitstream to extract digital samples and control information from the bitstream in accordance with the AC-3 format. Specifically, digital samples extracted from the bitstream are delivered to a buffer memory 16 via a digital transmission line 15.

As noted above, up to six channels may be encoded in an AC-3 compliant signal: five wideband channels and a sixth, low frequency effects channel. Since the low frequency effects channel is not used in the downmixing operation, samples for the low frequency effects are stored in a separate area 18 of memory 16 for later use. Samples for the remaining 1–5 wideband channels are stored in area 20 of memory 16 for use in downmixing operations, as described below.

Parameter extractor 14 also extracts downmixing parameters from the incoming bitstream on line 12. Specifically, extractor 14 obtains an indication of the input acmode (which is a three-bit value) and outputs this value to lines 22. Furthermore, additional parameters c_mix_val and sur_mix_val are retrieved, where applicable, from the bit stream and output on lines 24 and 26, respectively. As can be seen from the appendix to this application, c_mix_val and sur_mix_val are used in certain acmode/output_mode combinations to compute downmixing coefficients. Specifically, c_mix_val and sur_mix_val respectively indicate the extent to which the center channel or surround channels, respectively, should be mixed into other channels in situations where no center or surround channel, respectively, is to be output after the downmixing operation. Finally, parameter extractor 14 reads an area of the bitstream known as "bsmod", to determine whether the input signals are formatted for KARAOKE output. (KARAOKE format input signals have voice tracks separated from instrumental accompaniment, permitting sing-along playback.) "Bsmod" is a three bit word having the value "111" if the input is in KARAOKE mode. A bit identifying whether the input signal is in karaoke format is output on a line 28.

The samples and parameters extracted from the bitstream by extractor 14 are used by downmixing processor 30 to perform the downmixing operation. Specifically, downmixing processor 30 retrieves incoming samples from area 20 of memory 16, computes downmixing coefficients, performs appropriate multiply-and-accumulate (MAC) operations to generate output samples, and stores these output samples in area 32 of memory 16.

Listener-selected parameters are used by downmixing processor 30 in generating the downmixing coefficients and in selecting an appropriate downmnixing routine. These parameters are obtained from a user interface circuit 32. User interface circuit 32 includes buttons, touch screens or other input devices, as well as displays or other output systems for displaying the current status of the system to a listener 34 and also permitting listener 34 to alter that status using the input devices.

Through this interaction with the listener 34, user interface circuit 32 generates the appropriate listener-selected parameters specified by the AC-3 standard, which include the output mode selection output_mode on line 36 (a three-bit value).

Furthermore, user interface circuit 32 obtains other parameters values, which are used instead of the output_mode value, to determine the method of output when the input is acmode0. Specifically, user interface circuit 32 obtains the number of front speakers (a value of 1, 2 or 3) and outputs this value on lines 38. Also, user interface circuit allows the user to select a STEREO output mode, one of three monophonic output modes (specifically, a LEFTMONO output mode in which the output channels are monophonic and derived from the input left channel, a RIGHTMONO output mode in which the output channels are monophonic and derived from the input right channel, and a MIXMONO output mode in which the output channels are monophonic and derived from a mixed combination of the left and right input channels). The selection of the dualmode (one of a STEREO or various MONO output modes) is indicated on lines 40.

When the input signal is a KARAOKE mode signal, melody, first vocal and second vocal information are carried by the center, left surround and right surround channels, respectively. The AC-3 standard permits the listener to control whether the first vocal track "V1" and/or the second vocal track "V2" is included in the output. Accordingly, user interface circuit 32 allows the listener to identify two parameters for vocal playback, V1 (line 44) which indicates whether the first vocal track is to be included in the output, and V2 (line 46) which indicates whether the second vocal track is to be included in the output.

Downmixing processor 30 receives the input mode parameters on lines 22–28and the user-selected output mode parameters on lines 36–46 and uses these parameters to perform downmixing. Specifically, downmixing processor 30 includes a multiply-and-add (MAC) processor 50 for performing multiply-and-add processing as part of the downmixing routines. Further, downmixing processor 30 contains a coefficient generator 52 for generating downmixing coefficients for using by downmixing routines, in accordance with the various calculations specified in the appendix to this application. Downmixing processor further includes four stored software routines 54, 56, 58 and 60, which control MAC processor 50 to perform downmixing as described in FIG. 2 and the corresponding discussion below.

After computing output samples through downmixing, downmixing processor 30 delivers computed output samples to memory 16, area 62, so that these samples are available for output at the appropriate time. When samples are to be output, samples from area 62 and from LFE area 18, are retrieved by digital-to-analog converter 70 and converted to analog signals, which may then be amplified to drive the speakers 72 used by the listener. In the situation illustrated by FIG. 1, there are two such speakers, but in other cases, there may be additional speakers for surround sound, center channel and/or low frequency output, as indicated in dotted lines.

Figure 2:
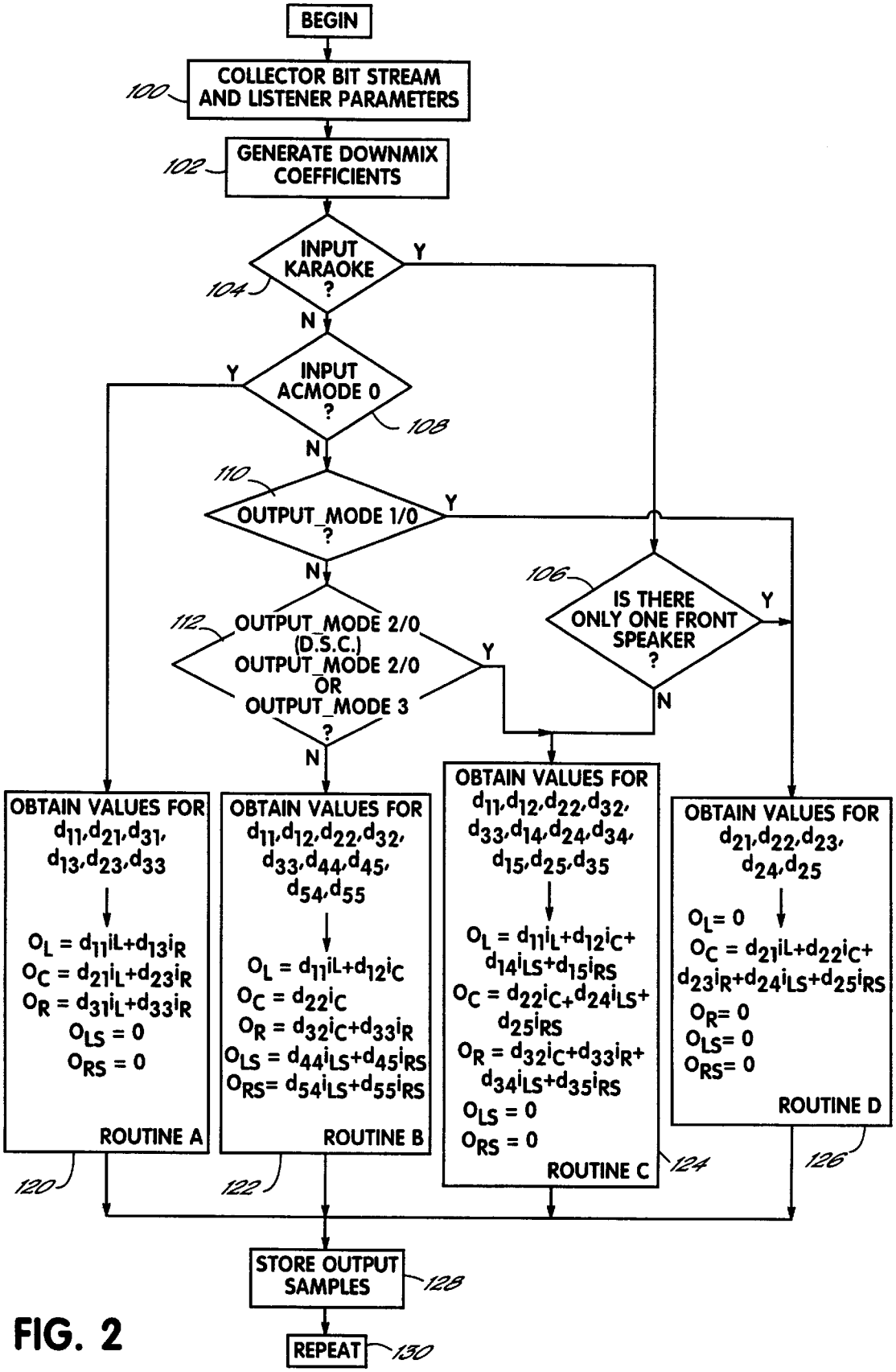
FIG. 2 is a flow chart of a downmixing method in accordance with principles of the present invention as performed by the computing circuit of FIG. 1.

Now referring to FIG. 2, the downmixing process for converting one set of input samples into a corresponding set of output samples can be understood. First, processor 30 collects the appropriate parameters for downmixing, obtained from the bit stream on line 12 by parameter extractor 14, and also the listener-set parameters from user interface 32. These parameters include the acmode and output_mode settings, as well as c_mix_val, sur_mix_val, the number of front speakers, dual mode (STEREO/LEFTMONO/ RIGHTMONO/ MIXMONO) setting and V1 and V2 settings.

After these parameters have been collected by downmixing processor 30, processor 30 generates the appropriate downmixing matrix coefficients (step 102) for the current input and output settings. The specific formulas used in computing the downmixing coefficients are identified in the appendix to this application. Note that if the input is not in KARAOKE mode, and the input signal is in any mode other than acmode0, then the output_mode/acmode combination is used to select the appropriate method for computing downmixing coefficients. If the input is not in KARAOKE mode, and the input signal is in acmodeO, then the method for computing downmixing coefficients is determined from the number of front speakers and the STEREO/LEFTMONO/RIGHTMONO/MIXMONO setting. If the input is in KARAOKE mode, the method for computing downmixing coefficients is determined from the number of front speakers. In each case, downmixing coefficients may need to be computed from the various parameters noted above, as is summarized in the appendix.

After computing the coefficients for the downmixing operation, processor 30 proceeds to compute output samples to be stored in memory area 62 from input samples stored in memory area 20. As noted above, this computation does not involve every coefficient in the downmixing matrix; rather, at least some of the zero-valued coefficients are ignored for the computation.

Figure 3:
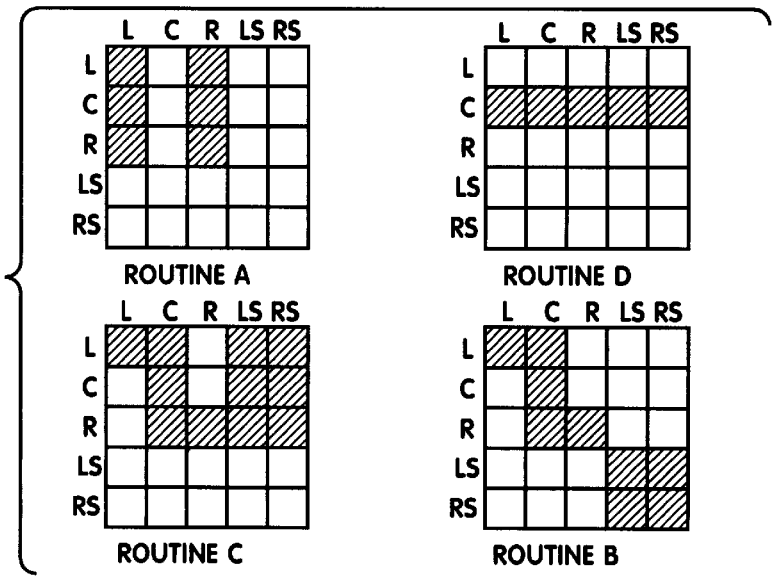
FIG. 3 is a graphical representation of the coefficients which are included in the computations performed by the four downmixing routines illustrated in FIG. 2.

There are four downmixing routines, each of which performs computations using a different set of downmixing coefficients. Referring now to FIG. 3, the coefficients involved in each of the routines can be viewed in a graphic form. Routine A, for example, will compute output samples from input samples using only coefficients $d_{11}$, $d_{13}$, $d_{21}$, $d_{23}$, $d_{31}$ and $d_{33}$. In Routine A, all other downmixing coefficients are assumed to be zero and are omitted from the output channel computations. Other patterns of coefficients are used by each of Routines B, C and D, as seen in FIG. 3 and explained in further detail below.

To select the appropriate routine for downmixing, processor 30 first determines whether the input is in KARAOKE mode (step 104). If so, processor 30 proceeds to step 106, and determines whether there is only one front speaker. If so, processor 30 proceeds to Routine D, step 126, to compute the output channels. If there is more than one front speaker at step 106, processor 30 proceeds to Routine C, step 124, to compute the output channels.

If the input is not in KARAOKE mode, processor 30 proceeds from step 104 to step 108, at which processor 30 determines whether the input is in acmode0. If so, processor 30 proceeds to Routine A, step 120, to compute the output channels. However, if the input is in another acmode, processor 30 proceeds to step 110, and determines whether the output is in output_mode 1/0. If the output is at output_mode 1/0 in step 110, processor 30 proceeds to Routine D, step 126, to compute the output channels. Otherwise, if the output is in another output_mode, processor 30 proceeds to step 112, and determines whether the output is in output_mode 2/0 (Dolby surround compatible), output_mode 2/0 or output_mode 3/0, in which case processor 30 proceeds to Routine C, step 124; otherwise, processor 30 proceeds to routine B, step 122.

As noted above, each of the four downmixing routines uses different combinations of downmixing coefficients from matrix D, and assumes the remaining coefficients are zero valued. Routine A, step 120, retrieves values for coefficients $d_{11}$, $d_{13}$, $d_{21}$, $d_{23}$, $d_{31}$ and $d_{33}$. Then, Routine A computes the values of samples for output channels $O_L$, $O_C$, $O_R$, $O_{LS}$, $O_{RS}$ in accordance with the equations:

$$O_L=d_{11}i_L+d_{13}i_R$$

$$O_C=d_{21}i_L+d_{23}i_R$$

$$O_R=d_{31}i_L+d_{33}i_R$$

$$O_{LS}=0$$

$$O_{RS}=0$$

Routine B, step 122, retrieves values for coefficients $d_{11}$, $d_{12}$, $d_{22}$, $d_{32}$, $d_{33}$, $d_{44}$, $d_{45}$, $d_{54}$, $d_{55}$. Then, Routine B computes the values of samples for output channels $O_L$, $O_C$, $O_R$, $O_{LS}$, $O_{RS}$ in accordance with the equations:

$$O_L=d_{11}i_L+d_{12}i_c$$

$$O_C=d_{22}i_C$$

$$O_R=d_{32}i_C+d_{33}i_R$$

$$O_{LS}=d_{44}i_{LS}+d_{45}i_{RS}$$

$$O_{RS}=d_{54}i_{LS}+d_{55}i_{RS}$$

Routine C, step 124, retrieves values for coefficients $d_{11}$, $d_{12}$, $d_{22}$, $d_{32}$, $d_{33}$, $d_{14}$, $d_{24}$, $d_{34}$, $d_{15}$, $d_{25}$ and $d_{35}$. Then, Routine C computes the values of samples for output channels $O_L$, $O_C$, $O_R$, $O_{LS}$, $O_{RS}$ in accordance with the equations:

$$O_L=d_{11}i_L+d_{12}i_C+d_{14}i_{LS}+d_{15}i_{RS}$$

$$O_C=d_{22}i_C+d_{24}i_{LS}+d_{25}i_{RS}$$

$$O_R=d_{32}i_C+d_{33}i_R+d_{34}i_{LS}+d_{35}i_{RS}$$

$$O_{LS}=0$$

$$O_{RS}=0$$

Routine D, step 124, retrieves values for coefficients $d_{21}$, $d_{22}$, $d_{23}$, $d_{24}$ and $d_{25}$. Then, Routine D computes the values of samples for output channels $O_L$, $O_C$, $O_R$, $O_{LS}$, $O_{RS}$ in accordance with the equations:

$$O_L=0$$

$$O_C=d_{21}i_L+d_{22}i_C+d_{23}i_R+d_{24}i_{LS}+d_{25}i_{RS}$$

$$O_R=0$$

$$O_{LS}=0$$

$$O_{RS}=0$$

The reader will note that the equations identified above are the same as the matrix calculation $$O=D\cdot i$$

discussed in the background, when certain downmixing coefficients $d_{**}$ are ignored.

After computing output samples from input samples as described above, downmixing processor 30 stores the output samples in area 62 of memory 16 for output (step 128), and then repeats the downmixing process for the next set of input samples i.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. For example, principles of the present invention may be applied to downmixing of information formatted in accordance with standards other than AC-3; furthermore, the specific downmixing routines and patterns of omitted entries illustrated herein might be altered without deviation from principles of the present invention. The invention in its broader aspects is therefore not limited to the specific details, representative apparatus and method, and illustrative example shown and described. Accordingly, departures may be made from such details without departing from the spirit or scope of applicant's general inventive concept.

Appendix

Downmixing coefficients for permitted input and output modes in accordance with AC-3 standard.

Identified below are the downinixing matrices D used in converting input samples to output samples for the 71 combinations of input and output modes supported under AC-3.

| | L | C | R | LS | RS |
|---|---|---|---|---|---|
| output_mode 2/0 (Dolby surround compatible) | | | | | |
| output_mode 2/0 / ac-mode1 | | | | | |
| L | 0 | $\sqrt{2}/2$ | 0 | 0 | 0 |
| C | 0 | 0 | 0 | 0 | 0 |
| R | 0 | $\sqrt{2}/2$ | 0 | 0 | 0 |
| LS | 0 | 0 | 0 | 0 | 0 |
| RS | 0 | 0 | 0 | 0 | 0 |
| output_mode 2/0 / ac-mode2 | | | | | |
| L | 1 | 0 | 0 | 0 | 0 |
| C | 0 | 0 | 0 | 0 | 0 |
| R | 0 | 0 | 1 | 0 | 0 |
| LS | 0 | 0 | 0 | 0 | 0 |
| RS | 0 | 0 | 0 | 0 | 0 |

-continued

| | L | C | R | LS | RS |
|---|---|---|---|---|---|
| output_mode 2/0 / ac-mode3 | | | | | |
| L | 1 | $\sqrt{2}/2$ | 0 | 0 | 0 |
| C | 0 | 0 | 0 | 0 | 0 |
| R | 0 | $\sqrt{2}/2$ | 1 | 0 | 0 |
| LS | 0 | 0 | 0 | 0 | 0 |
| RS | 0 | 0 | 0 | 0 | 0 |
| output_mode 2/0 / ac-mode4 | | | | | |
| L | 1 | 0 | 0 | $-\sqrt{2}/2$ | 0 |
| C | 0 | 0 | 0 | 0 | 0 |
| R | 0 | 0 | 1 | $\sqrt{2}/2$ | 0 |
| LS | 0 | 0 | 0 | 0 | 0 |
| RS | 0 | 0 | 0 | 0 | 0 |
| output_mode 2/0 / ac-mode5 | | | | | |
| L | 1 | $\sqrt{2}/2$ | 0 | $-\sqrt{2}/2$ | 0 |
| C | 0 | 0 | 0 | 0 | 0 |
| R | 0 | $\sqrt{2}/2$ | 1 | $\sqrt{2}/2$ | 0 |
| LS | 0 | 0 | 0 | 0 | 0 |
| RS | 0 | 0 | 0 | 0 | 0 |
| output_mode 2/0 / ac-mode6 | | | | | |
| L | 1 | 0 | 0 | $-\sqrt{2}/2$ | $-\sqrt{2}/2$ |
| C | 0 | 0 | 0 | 0 | 0 |
| R | 0 | 0 | 1 | $\sqrt{2}/2$ | $\sqrt{2}/2$ |
| LS | 0 | 0 | 0 | 0 | 0 |
| RS | 0 | 0 | 0 | 0 | 0 |
| output_mode 2/0 / ac-mode7 | | | | | |
| L | 1 | $\sqrt{2}/2$ | 0 | $-\sqrt{2}/2$ | $-\sqrt{2}/2$ |
| C | 0 | 0 | 0 | 0 | 0 |
| R | 0 | $\sqrt{2}/2$ | 1 | $\sqrt{2}/2$ | $\sqrt{2}/2$ |
| LS | 0 | 0 | 0 | 0 | 0 |
| RS | 0 | 0 | 0 | 0 | 0 |
| output_mode 1/0 | | | | | |
| output_mode 1/0 / ac-mode1 | | | | | |
| L | 0 | 0 | 0 | 0 | 0 |
| C | 0 | 1 | 0 | 0 | 0 |
| R | 0 | 0 | 0 | 0 | 0 |
| LS | 0 | 0 | 0 | 0 | 0 |
| RS | 0 | 0 | 0 | 0 | 0 |

-continued

| | L | C | R | LS | RS |
|---|---|---|---|---|---|
| | | output_mode 1/0 / ac-mode2 | | | |
| L | 0 | 0 | 0 | 0 | 0 |
| C | $\sqrt{2}/2$ | 0 | $\sqrt{2}/2$ | 0 | 0 |
| R | 0 | 0 | 0 | 0 | 0 |
| LS | 0 | 0 | 0 | 0 | 0 |
| RS | 0 | 0 | 0 | 0 | 0 |
| | | output_mode 1/0 / ac-mode3 | | | |
| L | 0 | 0 | 0 | 0 | 0 |
| C | $\sqrt{2}/2$ | (a) | $\sqrt{2}/2$ | 0 | 0 |
| R | 0 | 0 | 0 | 0 | 0 |
| LS | 0 | 0 | 0 | 0 | 0 |
| RS | 0 | 0 | 0 | 0 | 0 |

(a) = c_mix_val $*\sqrt{2}/2*2$

'c_mix_val' is encoded in the bitstream.

| | | | | | |
|---|---|---|---|---|---|
| | | output_mode 1/0 / ac-mode4 | | | |
| L | 0 | 0 | 0 | 0 | 0 |
| C | $\sqrt{2}/2$ | 0 | $\sqrt{2}/2$ | (a) | 0 |
| R | 0 | 0 | 0 | 0 | 0 |
| LS | 0 | 0 | 0 | 0 | 0 |
| RS | 0 | 0 | 0 | 0 | 0 |

(a) = sur_mix_val $*\sqrt{2}/2$

'sur_mix_val' is encoded in the bitstream.

| | | | | | |
|---|---|---|---|---|---|
| | | output_mode 1/0 / ac-mode5 | | | |
| L | 0 | 0 | 0 | 0 | 0 |
| C | $\sqrt{2}/2$ | (a) | $\sqrt{2}/2$ | (b) | 0 |
| R | 0 | 0 | 0 | 0 | 0 |
| LS | 0 | 0 | 0 | 0 | 0 |
| RS | 0 | 0 | 0 | 0 | 0 |

(a) = c_mix_val $*\sqrt{2}/2*2$ (b) = sur_mix_val $*\sqrt{2}/2$

'c_mix_val' and 'sur_mix_val' are encoded in the bitstream.

| | | | | | |
|---|---|---|---|---|---|
| | | output_mode 1/0 / ac-mode6 | | | |
| L | 0 | 0 | 0 | 0 | 0 |
| C | $\sqrt{2}/2$ | 0 | $\sqrt{2}/2$ | (a) | (a) |
| R | 0 | 0 | 0 | 0 | 0 |
| LS | 0 | 0 | 0 | 0 | 0 |
| RS | 0 | 0 | 0 | 0 | 0 |

(a) = sur_mix_val $*\sqrt{2}/2$

'c_mix_val' and 'sur_mix_val' are encoded in the bitstream.

| | | | | | |
|---|---|---|---|---|---|
| | | output_mode 1/0 / ac-mode7 | | | |
| L | 0 | 0 | 0 | 0 | 0 |
| C | $\sqrt{2}/2$ | (a) | $\sqrt{2}/2$ | (b) | (b) |
| R | 0 | 0 | 0 | 0 | 0 |
| LS | 0 | 0 | 0 | 0 | 0 |
| RS | 0 | 0 | 0 | 0 | 0 |

(a) = c_mix_val $*\sqrt{2}/2*2$ (b) = sur_mix_val $*\sqrt{2}/2$

'c_mix_val' and 'sur_mix_val' are encoded in the bitstream.

-continued

| | L | C | R | LS | RS |
|---|---|---|---|---|---|
| | | output_mode 2/0 | | | |
| | | output_mode 2/0 / ac-mode1 | | | |
| L | 0 | $\sqrt{2}/2$ | 0 | 0 | 0 |
| C | 0 | 0 | 0 | 0 | 0 |
| R | 0 | $\sqrt{2}/2$ | 0 | 0 | 0 |
| LS | 0 | 0 | 0 | 0 | 0 |
| RS | 0 | 0 | 0 | 0 | 0 |
| | | output_mode 2/0 / ac-mode2 | | | |
| L | 1 | 0 | 0 | 0 | 0 |
| C | 0 | 0 | 0 | 0 | 0 |
| R | 0 | 0 | 1 | 0 | 0 |
| LS | 0 | 0 | 0 | 0 | 0 |
| RS | 0 | 0 | 0 | 0 | 0 |
| | | output_mode 2/0 / ac-mode3 | | | |
| L | 1 | (a) | 0 | 0 | 0 |
| C | 0 | 0 | 0 | 0 | 0 |
| R | 0 | (a) | 1 | 0 | 0 |
| LS | 0 | 0 | 0 | 0 | 0 |
| RS | 0 | 0 | 0 | 0 | 0 |

(a) = c_mix_val

'c_mix_val' is encoded in the bitstream.

| | | | | | |
|---|---|---|---|---|---|
| | | output_mode 2/0 / ac-mode4 | | | |
| L | 1 | 0 | 0 | (a) | 0 |
| C | 0 | 0 | 0 | 0 | 0 |
| R | 0 | 0 | 1 | (a) | 0 |
| LS | 0 | 0 | 0 | 0 | 0 |
| RS | 0 | 0 | 0 | 0 | 0 |

(a) = sur_mix_val $*\sqrt{2}/2$

'sur_mix_val' is encoded in the bitstream.

| | | | | | |
|---|---|---|---|---|---|
| | | output_mode 2/0 / ac-mode5 | | | |
| L | 1 | (a) | 0 | (b) | 0 |
| C | 0 | 0 | 0 | 0 | 0 |
| R | 0 | (a) | 1 | (b) | 0 |
| LS | 0 | 0 | 0 | 0 | 0 |
| RS | 0 | 0 | 0 | 0 | 0 |

(a) = c_mix_val (b) = sur_mix_val $*\sqrt{2}/2$

'c_mix_val' and 'sur_mix_val' are encoded in the bitstream.

| | | | | | |
|---|---|---|---|---|---|
| | | output_mode 2/0 / ac-mode6 | | | |
| L | 1 | 0 | 0 | (a) | 0 |
| C | 0 | 0 | 0 | 0 | 0 |
| R | 0 | 0 | 1 | 0 | (a) |
| LS | 0 | 0 | 0 | 0 | 0 |
| RS | 0 | 0 | 0 | 0 | 0 |

(a) = sur_mix_val

'sur_mix_val' is encoded in the bitstream.

| | | | | | |
|---|---|---|---|---|---|
| | | output_mode 2/0 / ac-mode7 | | | |
| L | 1 | (a) | 0 | (b) | 0 |
| C | 0 | 0 | 0 | 0 | 0 |
| R | 0 | (a) | 1 | 0 | (b) |
| LS | 0 | 0 | 0 | 0 | 0 |
| RS | 0 | 0 | 0 | 0 | 0 |

(a) = c_mix_val (b) = sur_mix_val

'c_mix_val' and 'sur_mix_val' are encoded in the bitstream.

| | | | | | |
|---|---|---|---|---|---|
| | | output_mode 3/0 | | | |
| | | output_mode 3/0 / ac-mode1 | | | |
| L | 0 | 0 | 0 | 0 | 0 |
| C | 0 | 1 | 0 | 0 | 0 |
| R | 0 | 0 | 0 | 0 | 0 |

-continued

| | L | C | R | LS | RS |
|---|---|---|---|---|---|
| LS | 0 | 0 | 0 | 0 | 0 |
| RS | 0 | 0 | 0 | 0 | 0 |

output_mode 3/0 / ac-mode2

| | | | | | |
|---|---|---|---|---|---|
| L | 1 | 0 | 0 | 0 | 0 |
| C | 0 | 0 | 0 | 0 | 0 |
| R | 0 | 0 | 1 | 0 | 0 |
| LS | 0 | 0 | 0 | 0 | 0 |
| RS | 0 | 0 | 0 | 0 | 0 |

output_mode 3/0 / ac-mode3

| | | | | | |
|---|---|---|---|---|---|
| L | 1 | 0 | 0 | 0 | 0 |
| C | 0 | 1 | 0 | 0 | 0 |
| R | 0 | 0 | 1 | 0 | 0 |
| LS | 0 | 0 | 0 | 0 | 0 |
| RS | 0 | 0 | 0 | 0 | 0 |

output_mode 3/0 / ac-mode4

| | | | | | |
|---|---|---|---|---|---|
| L | 1 | 0 | 0 | (a) | 0 |
| C | 0 | 0 | 0 | 0 | 0 |
| R | 0 | 0 | 1 | (a) | 0 |
| LS | 0 | 0 | 0 | 0 | 0 |
| RS | 0 | 0 | 0 | 0 | 0 |

(a) = sur_mix_val $*\sqrt{2}/2$

'sur_mix_val' is encoded in the bitstream.

output_mode 3/0 / ac-mode5

| | | | | | |
|---|---|---|---|---|---|
| L | 1 | 0 | 0 | (a) | 0 |
| C | 0 | 1 | 0 | 0 | 0 |
| R | 0 | 0 | 1 | (a) | 0 |
| LS | 0 | 0 | 0 | 0 | 0 |
| RS | 0 | 0 | 0 | 0 | 0 |

(a) = sur_mix_val $*\sqrt{2}/2$

'sur_mix_val' is encoded in the bitstream.

output_mode 3/0 / ac-mode6

| | | | | | |
|---|---|---|---|---|---|
| L | 1 | 0 | 0 | (a) | 0 |
| C | 0 | 0 | 0 | 0 | 0 |
| R | 0 | 0 | 1 | 0 | (a) |
| LS | 0 | 0 | 0 | 0 | 0 |
| RS | 0 | 0 | 0 | 0 | 0 |

(a) = sur_mix_val

'sur_mix_val' is encoded in the bitstream.

output_mode 3/0 / ac-mode7

| | | | | | |
|---|---|---|---|---|---|
| L | 1 | 0 | 0 | (a) | 0 |
| C | 0 | 1 | 0 | 0 | 0 |
| R | 0 | 0 | 1 | 0 | (a) |
| LS | 0 | 0 | 0 | 0 | 0 |
| RS | 0 | 0 | 0 | 0 | 0 |

(a) = sur_mix_val

'sur_mix_val' is encoded in the bitstream.

output_mode 2/1 output_mode 2/1 / ac-mode1

| | | | | | |
|---|---|---|---|---|---|
| L | 0 | $\sqrt{2}/2$ | 0 | 0 | 0 |
| C | 0 | 0 | 0 | 0 | 0 |
| R | 0 | $\sqrt{2}/2$ | 0 | 0 | 0 |
| LS | 0 | 0 | 0 | 0 | 0 |
| RS | 0 | 0 | 0 | 0 | 0 |

output_mode 2/1 / ac-mode2

| | | | | | |
|---|---|---|---|---|---|
| L | 1 | 0 | 0 | 0 | 0 |
| C | 0 | 0 | 0 | 0 | 0 |
| R | 0 | 0 | 1 | 0 | 0 |
| LS | 0 | 0 | 0 | 0 | 0 |
| RS | 0 | 0 | 0 | 0 | 0 |

-continued output_mode 2/1 / ac-mode3

| | | | | | |
|---|---|---|---|---|---|
| L | 1 | (a) | 0 | 0 | 0 |
| C | 0 | 0 | 0 | 0 | 0 |
| R | 0 | (a) | 1 | 0 | 0 |
| LS | 0 | 0 | 0 | 0 | 0 |
| RS | 0 | 0 | 0 | 0 | 0 |

(a) = c_mix_val

'c_mix_val' is encoded in the bitstream.

output_mode 2/1 / ac-mode4

| | | | | | |
|---|---|---|---|---|---|
| L | 1 | 0 | 0 | 0 | 0 |
| C | 0 | 0 | 0 | 0 | 0 |
| R | 0 | 0 | 1 | 0 | 0 |
| LS | 0 | 0 | 0 | 1 | 0 |
| RS | 0 | 0 | 0 | 0 | 0 |

output_mode 2/1 / ac-mode5

| | | | | | |
|---|---|---|---|---|---|
| L | 1 | (a) | 0 | 0 | 0 |
| C | 0 | 0 | 0 | 0 | 0 |
| R | 0 | (a) | 1 | 0 | 0 |
| LS | 0 | 0 | 0 | 1 | 0 |
| RS | 0 | 0 | 0 | 0 | 0 |

(a) = c_mix_val

'c_mix_val' is encoded in the bitstream.

output_mode 2/1 / ac-mode6

| | | | | | |
|---|---|---|---|---|---|
| L | 1 | 0 | 0 | 0 | 0 |
| C | 0 | 0 | 0 | 0 | 0 |
| R | 0 | 0 | 1 | 0 | 0 |
| LS | 0 | 0 | 0 | $\sqrt{2}/2$ | $\sqrt{2}/2$ |
| RS | 0 | 0 | 0 | 0 | 0 |

output_mode 2/1 / ac-mode7

| | | | | | |
|---|---|---|---|---|---|
| L | 1 | (a) | 0 | 0 | 0 |
| C | 0 | 0 | 0 | 0 | 0 |
| R | 0 | (a) | 1 | 0 | 0 |
| LS | 0 | 0 | 0 | $\sqrt{2}/2$ | $\sqrt{2}/2$ |
| RS | 0 | 0 | 0 | 0 | 0 |

(a) = c_mix_val

'c_mix_val' is encoded in the bitstream.

output_mode 3/1 output_mode 3/1 / ac-mode1

| | | | | | |
|---|---|---|---|---|---|
| L | 0 | 0 | 0 | 0 | 0 |
| C | 0 | 1 | 0 | 0 | 0 |
| R | 0 | 0 | 0 | 0 | 0 |
| LS | 0 | 0 | 0 | 0 | 0 |
| RS | 0 | 0 | 0 | 0 | 0 |

output_mode 3/1 / ac-mode2

| | | | | | |
|---|---|---|---|---|---|
| L | 1 | 0 | 0 | 0 | 0 |
| C | 0 | 0 | 0 | 0 | 0 |
| R | 0 | 0 | 1 | 0 | 0 |
| LS | 0 | 0 | 0 | 0 | 0 |
| RS | 0 | 0 | 0 | 0 | 0 |

output_mode 3/1 / ac-mode3

| | | | | | |
|---|---|---|---|---|---|
| L | 1 | 0 | 0 | 0 | 0 |
| C | 0 | 1 | 0 | 0 | 0 |
| R | 0 | 0 | 1 | 0 | 0 |
| LS | 0 | 0 | 0 | 0 | 0 |
| RS | 0 | 0 | 0 | 0 | 0 |

output_mode 3/1 / ac-mode4

| | | | | | |
|---|---|---|---|---|---|
| L | 1 | 0 | 0 | 0 | 0 |
| C | 0 | 0 | 0 | 0 | 0 |
| R | 0 | 0 | 1 | 0 | 0 |
| LS | 0 | 0 | 0 | 1 | 0 |
| RS | 0 | 0 | 0 | 0 | 0 |

-continued

| | L | C | R | LS | RS |
|---|---|---|---|---|---|
| | | output_mode 3/1 / ac-mode5 | | | |
| L | 1 | 0 | 0 | 0 | 0 |
| C | 0 | 1 | 0 | 0 | 0 |
| R | 0 | 0 | 1 | 0 | 0 |
| LS | 0 | 0 | 0 | 1 | 0 |
| RS | 0 | 0 | 0 | 0 | 0 |
| | | output_mode 3/1 / ac-mode6 | | | |
| L | 1 | 0 | 0 | 0 | 0 |
| C | 0 | 0 | 0 | 0 | 0 |
| R | 0 | 0 | 1 | 0 | 0 |
| LS | 0 | 0 | 0 | $\sqrt{2}/2$ | $\sqrt{2}/2$ |
| RS | 0 | 0 | 0 | 0 | 0 |
| | | output_mode 3/1 / ac-mode7 | | | |
| L | 1 | 0 | 0 | 0 | 0 |
| C | 0 | 1 | 0 | 0 | 0 |
| R | 0 | 0 | 1 | 0 | 0 |
| LS | 0 | 0 | 0 | $\sqrt{2}/2$ | $\sqrt{2}/2$ |
| RS | 0 | 0 | 0 | 0 | 0 |
| | | output_mode 2/2 | | | |
| | | output_mode 2/2 / ac-mode1 | | | |
| L | 0 | $\sqrt{2}/2$ | 0 | 0 | 0 |
| C | 0 | 0 | 0 | 0 | 0 |
| R | 0 | $\sqrt{2}/2$ | 0 | 0 | 0 |
| LS | 0 | 0 | 0 | 0 | 0 |
| RS | 0 | 0 | 0 | 0 | 0 |
| | | output_mode 2/2 / ac-mode2 | | | |
| L | 1 | 0 | 0 | 0 | 0 |
| C | 0 | 0 | 0 | 0 | 0 |
| R | 0 | 0 | 1 | 0 | 0 |
| LS | 0 | 0 | 0 | 0 | 0 |
| RS | 0 | 0 | 0 | 0 | 0 |
| | | output_mode 2/2 / ac-mode3 | | | |
| L | 1 | (a) | 0 | 0 | 0 |
| C | 0 | 0 | 0 | 0 | 0 |
| R | 0 | (a) | 1 | 0 | 0 |
| LS | 0 | 0 | 0 | 0 | 0 |
| RS | 0 | 0 | 0 | 0 | 0 |

(a) = c_mix_val
'c_mix_val' is encoded in the bitstream.

| | L | C | R | LS | RS |
|---|---|---|---|---|---|
| | | output_mode 2/2 / ac-mode4 | | | |
| L | 1 | 0 | 0 | 0 | 0 |
| C | 0 | 0 | 0 | 0 | 0 |
| R | 0 | 0 | 1 | 0 | 0 |
| LS | 0 | 0 | 0 | $\sqrt{2}/2$ | 0 |
| RS | 0 | 0 | 0 | $\sqrt{2}/2$ | 0 |
| | | output_mode 2/2 / ac-mode5 | | | |
| L | 1 | (a) | 0 | 0 | 0 |
| C | 0 | 0 | 0 | 0 | 0 |
| R | 0 | (a) | 1 | 0 | 0 |
| LS | 0 | 0 | 0 | $\sqrt{2}/2$ | 0 |
| RS | 0 | 0 | 0 | $\sqrt{2}/2$ | 0 |

(a) = c_mix_val
'c_mix_val' is encoded in the bitstream.

| | L | C | R | LS | RS |
|---|---|---|---|---|---|
| | | output_mode 2/2 / ac-mode6 | | | |
| L | 1 | 0 | 0 | 0 | 0 |
| C | 0 | 0 | 0 | 0 | 0 |
| R | 0 | 0 | 1 | 0 | 0 |
| LS | 0 | 0 | 0 | 1 | 0 |
| RS | 0 | 0 | 0 | 0 | 1 |
| | | output_mode 2/2 / ac-mode7 | | | |
| L | 1 | (a) | 0 | 0 | 0 |
| C | 0 | 0 | 0 | 0 | 0 |
| R | 0 | (a) | 1 | 0 | 0 |
| LS | 0 | 0 | 0 | 1 | 0 |
| RS | 0 | 0 | 0 | 0 | 1 |

(a) = c_mix_val
'c_mix_val' is encoded in the bitstream.

| | L | C | R | LS | RS |
|---|---|---|---|---|---|
| | | output_mode 3/2 | | | |
| | | output_mode 3/2 / ac-mode1 | | | |
| L | 0 | 0 | 0 | 0 | 0 |
| C | 0 | 1 | 0 | 0 | 0 |
| R | 0 | 0 | 0 | 0 | 0 |
| LS | 0 | 0 | 0 | 0 | 0 |
| RS | 0 | 0 | 0 | 0 | 0 |
| | | output_mode 3/2 / ac-mode2 | | | |
| L | 1 | 0 | 0 | 0 | 0 |
| C | 0 | 0 | 0 | 0 | 0 |
| R | 0 | 0 | 1 | 0 | 0 |
| LS | 0 | 0 | 0 | 0 | 0 |
| RS | 0 | 0 | 0 | 0 | 0 |
| | | output_mode 3/2 / ac-mode3 | | | |
| L | 1 | 0 | 0 | 0 | 0 |
| C | 0 | 1 | 0 | 0 | 0 |
| R | 0 | 0 | 1 | 0 | 0 |
| LS | 0 | 0 | 0 | 0 | 0 |
| RS | 0 | 0 | 0 | 0 | 0 |
| | | output_mode 3/2 / ac-mode4 | | | |
| L | 1 | 0 | 0 | 0 | 0 |
| C | 0 | 0 | 0 | 0 | 0 |
| R | 0 | 0 | 1 | 0 | 0 |
| LS | 0 | 0 | 0 | $\sqrt{2}/2$ | 0 |
| RS | 0 | 0 | 0 | $\sqrt{2}/2$ | 0 |
| | | output_mode 3/2 / ac-mode5 | | | |
| L | 1 | 0 | 0 | 0 | 0 |
| C | 0 | 1 | 0 | 0 | 0 |
| R | 0 | 0 | 1 | 0 | 0 |
| LS | 0 | 0 | 0 | $\sqrt{2}/2$ | 0 |
| RS | 0 | 0 | 0 | $\sqrt{2}/2$ | 0 |
| | | output_mode 3/2 / ac-mode6 | | | |
| L | 1 | 0 | 0 | 0 | 0 |
| C | 0 | 0 | 0 | 0 | 0 |
| R | 0 | 0 | 1 | 0 | 0 |
| LS | 0 | 0 | 0 | 1 | 0 |
| RS | 0 | 0 | 0 | 0 | 1 |

-continued

| | L | C | R | LS | RS |
|---|---|---|---|---|---|
| | | output_mode 3/2 / ac-mode7 | | | |
| L | 1 | 0 | 0 | 0 | 0 |
| C | 0 | 1 | 0 | 0 | 0 |
| R | 0 | 0 | 1 | 0 | 0 |
| LS | 0 | 0 | 0 | 1 | 0 |
| RS | 0 | 0 | 0 | 0 | 1 |
| | | mode11(ac-mode0) | | | |
| | | outfront1/DUAL_STEREO | | | |
| L | 0 | 0 | 0 | 0 | 0 |
| C | ½ | 0 | ½ | 0 | 0 |
| R | 0 | 0 | 0 | 0 | 0 |
| LS | 0 | 0 | 0 | 0 | 0 |
| RS | 0 | 0 | 0 | 0 | 0 |
| | | outfront1/DUAL_LEFTMONO | | | |
| L | 0 | 0 | 0 | 0 | 0 |
| C | 1 | 0 | 0 | 0 | 0 |
| R | 0 | 0 | 0 | 0 | 0 |
| LS | 0 | 0 | 0 | 0 | 0 |
| RS | 0 | 0 | 0 | 0 | 0 |
| | | outfront1/DUAL_RGHTMONO | | | |
| L | 0 | 0 | 0 | 0 | 0 |
| C | 0 | 0 | 1 | 0 | 0 |
| R | 0 | 0 | 0 | 0 | 0 |
| LS | 0 | 0 | 0 | 0 | 0 |
| RS | 0 | 0 | 0 | 0 | 0 |
| | | outfront1/DUAL_MIXMONO | | | |
| L | 0 | 0 | 0 | 0 | 0 |
| C | ½ | 0 | ½ | 0 | 0 |
| R | 0 | 0 | 0 | 0 | 0 |
| LS | 0 | 0 | 0 | 0 | 0 |
| RS | 0 | 0 | 0 | 0 | 0 |
| | | outfront2/DUAL_STEREO | | | |
| L | 1 | 0 | 0 | 0 | 0 |
| C | 0 | 0 | 0 | 0 | 0 |
| R | 0 | 0 | 1 | 0 | 0 |
| LS | 0 | 0 | 0 | 0 | 0 |
| RS | 0 | 0 | 0 | 0 | 0 |
| | | outfront2/DUAL_LEFTMONO | | | |
| L | $\sqrt{2}/2$ | 0 | 0 | 0 | 0 |
| C | 0 | 0 | 0 | 0 | 0 |
| R | $\sqrt{2}/2$ | 0 | 0 | 0 | 0 |
| LS | 0 | 0 | 0 | 0 | 0 |
| RS | 0 | 0 | 0 | 0 | 0 |
| | | outfront2/DUAL_RGHTMONO | | | |
| L | 0 | 0 | $\sqrt{2}/2$ | 0 | 0 |
| C | 0 | 0 | 0 | 0 | 0 |
| R | 0 | 0 | $\sqrt{2}/2$ | 0 | 0 |
| LS | 0 | 0 | 0 | 0 | 0 |
| RS | 0 | 0 | 0 | 0 | 0 |
| | | outfront2/DUAL_MIXMONO | | | |
| L | ½ | 0 | ½ | 0 | 0 |
| C | 0 | 0 | 0 | 0 | 0 |
| R | ½ | 0 | ½ | 0 | 0 |
| LS | 0 | 0 | 0 | 0 | 0 |
| RS | 0 | 0 | 0 | 0 | 0 |

-continued

| | L | C | R | LS | RS |
|---|---|---|---|---|---|
| | | outfront3/DUAL_STEREO | | | |
| L | 1 | 0 | 0 | 0 | 0 |
| C | 0 | 0 | 0 | 0 | 0 |
| R | 0 | 0 | 1 | 0 | 0 |
| LS | 0 | 0 | 0 | 0 | 0 |
| RS | 0 | 0 | 0 | 0 | 0 |
| | | outfront3/DUAL_LEFTMONO | | | |
| L | 0 | 0 | 0 | 0 | 0 |
| C | 1 | 0 | 0 | 0 | 0 |
| R | 0 | 0 | 0 | 0 | 0 |
| LS | 0 | 0 | 0 | 0 | 0 |
| RS | 0 | 0 | 0 | 0 | 0 |
| | | outfront3/DUAL_RGHTMONO | | | |
| L | 0 | 0 | 0 | 0 | 0 |
| C | 0 | 0 | 1 | 0 | 0 |
| R | 0 | 0 | 0 | 0 | 0 |
| LS | 0 | 0 | 0 | 0 | 0 |
| RS | 0 | 0 | 0 | 0 | 0 |
| | | outfront3/DUAL_MIXMONO | | | |
| L | 0 | 0 | 0 | 0 | 0 |
| C | ½ | 0 | ½ | 0 | 0 |
| R | 0 | 0 | 0 | 0 | 0 |
| LS | 0 | 0 | 0 | 0 | 0 |
| RS | 0 | 0 | 0 | 0 | 0 |
| | | KARAOKE | | | |
| | | outfront1 | | | |
| L | 0 | 0 | 0 | 0 | 0 |
| C | $\sqrt{2}/2$ | (a) | $\sqrt{2}/2$ | (b) | (c) |
| R | 0 | 0 | 0 | 0 | 0 |
| LS | 0 | 0 | 0 | 0 | 0 |
| RS | 0 | 0 | 0 | 0 | 0 |

(a) = c_mix_val $*\sqrt{2}$ (b) = $\sqrt{2}/2$ if first vocal channel (V1) is enabled, otherwise 0

(c) = $\sqrt{2}/2$ if second vocal channel (V2) is enabled, otherwise 0 c_mix_val is encoded in the bitstream.

V1 and V2 are specified by the user.

| | | | outfront2 | | |
|---|---|---|---|---|---|
| L | 1 | (a) | 0 | (b) | (d) |
| C | 0 | 0 | 0 | 0 | 0 |
| R | 0 | (a) | 1 | (c) | (e) |
| LS | 0 | 0 | 0 | 0 | 0 |
| RS | 0 | 0 | 0 | 0 | 0 |

(a) = c_mix_val (b) = $\sqrt{2}/2$ if only first vocal channel (V1) is enabled, 1 if first and second vocal channels (V1 + V2) are enabled,
0 otherwise.

(c) = $\sqrt{2}/2$ if only first vocal channel (V1) is enabled, 0 otherwise.

(d) = $\sqrt{2}/2$ if only second vocal channel (V2) is enabled, 0 otherwise.

(e) = $\sqrt{2}/2$ if only second vocal channel (V2) is enabled, 1 if first and second vocal channels (V1 + V2) are enabled,
0 otherwise.
c_mix_val is encoded in the bitstream.
V1 and V2 are specified by the user.

| | | | outfront3 | | |
|---|---|---|---|---|---|
| L | 1 | 0 | 0 | (a) | 0 |
| C | 0 | 1 | 0 | (b) | (c) |
| R | 0 | 0 | 1 | 0 | (a) |

-continued

| | L | C | R | LS | RS |
|---|---|---|---|---|---|
| LS | 0 | 0 | 0 | 0 | 0 |
| RS | 0 | 0 | 0 | 0 | 0 |

(a) = 1 if first and second vocal channels (V1 + V2) are enabled, 0 otherwise.
(b) = 1 if only first vocal channel (V1) is enabled, 0 otherwise.
(c) = 1 if only second vocal channel (V2) is enabled, 0 otherwise.
V1 and V2 are specified by the user.

What is claimed is:

1. A method for converting a multi-channel input signal to a multi-channel output signal, in a manner capable of handling a variable number of channels in said input or output signal, comprising, for a first combination of an input and an output signal, the steps of:

generating a first number of coefficients for converting input channels in said input signal to output channels to be included in said output signal, at least one of said first number of coefficients having a zero value, forming a first set of products equal in number to said first number of coefficients, each product formed from a selected one of said input channels multiplied by a selected one of said first number of coefficients, and computing a first output channel from a first sum of one or more products of said first set of products, and computing a second output channel from a second sum of at least one or more products of said first set of products, at least one of said first or second sums having a zero value regardless of an input signal value;

and further comprising, for a second different combination of an input and an output signal, the steps of:

generating a second number of coefficients for converting input channels in said input signal to output channels to be included in said output signal, said second number of coefficients being unequal to said first number of coefficients, forming a second set of products equal in number to said second number of coefficients, each product formed from a selected one of said input channels multiplied by a selected one of said second number of coefficients, and computing an output channel from a sum of one or more products of said second set of products.

2. The method of claim 1 wherein said input signal is compliant with a Dolby AC-3 standard promulgated by Dolby Laboratories, and said generating steps comprise generating coefficients specified by said AC-3 standard.

3. The method of claim 1 wherein said first computing step further comprises computing further output channels from sums of one or more products of said first set of products.

4. The method of claim 3 wherein said second computing step further comprises computing further output channels from sums of one or more products of said second set of products.

5. The method of claim 1 wherein said second computing step further comprises computing further output channels from sums of one or more products of said second set of products.

6. The method of claim 1 further comprising extracting a first parameter from said input signal, and wherein one of said coefficients is generated in response to said extracted first parameter.

7. The method of claim 6 further comprising extracting a second parameter from said input signal, and wherein one of said coefficients is generated in response to said extracted second parameter.

8. The method of claim 7 wherein one of said coefficients is generated in response to said extracted first and second parameters.

9. The method of claim 1 further comprising, for a third different combination of an input and an output signal, the steps of:

generating a third number of coefficients for converting input channels in said input signal to output channels to be included in said output signal, said third number of coefficients being unequal to said first and second numbers of coefficients, forming a third set of products equal in number to said third number of coefficients, each product formed from a selected one of said input channels multiplied by a selected one of said third number of coefficients, and computing an output channel from a sum of one or more products of said third set of products.

10. The method of claim 1 further comprising obtaining, from an operator, a first parameter indicating an output mode, and wherein one of said coefficients is generated in response to said first parameter.

11. The method of claim 10 further comprising obtaining, from an operator, a second parameter indicating an output mode, and wherein one of said coefficients is generated in response to said second parameter.

12. The method of claim 11 wherein one of said coefficients is generated in response to said first and second parameters.

13. Apparatus for converting a multi-channel input signal to a multi-channel output signal, in a manner capable of handling a variable number of channels in said input or output signal, comprising:

a memory storing samples of said multi-channel input signal and samples of said multi-channel output signal, a first computational unit generating, for a first combination of an input and an output signal, a first number of coefficients for converting input channels in said input signal to output channels to be included in said output signal, at least one of said first number of coefficients having a zero value, and generating, for a second different combination of an input and an output signal, a second number of such coefficients, said second number of coefficients being unequal to said first number of coefficients, a second computational unit forming a set of products equal in number to a number of generated coefficients, each product formed from a selected one of said input channels multiplied by a selected one of said coefficients, and a third computational unit computing output channels from sums of one or more products of said set of products, at least one of said sums having a zero value regardless of an input signal value.

14. The apparatus of claim 13 wherein said input signal is compliant with a Dolby AC-3 standard promulgated by Dolby Laboratories, and said first computational unit generates coefficients as specified by said AC-3 standard.

15. The apparatus of claim 13 wherein said third computational unit computes further output channels from sums of one or more products of said first set of products.

16. The apparatus of claim 13 further comprising a fourth computational unit extracting a first parameter from said input signal, and wherein said first computational unit generates one of said coefficients in response to said extracted first parameter.

17. The apparatus of claim 16 wherein said fourth computational unit extracts a second parameter from said input signal, and wherein said first computational unit generates one of said coefficients in response to said extracted second parameter.

18. The apparatus of claim 17 wherein said first computational unit generates one of said coefficients in response to said extracted first and second parameters.

19. The apparatus of claim 13 wherein, for a third different combination of an input and an output signal, said first computational unit generates a third number of coefficients for converting input channels in said input signal to output channels to be included in said output signal, said third number of coefficients being unequal to said first and second numbers of coefficients, said second computational unit forms a set of products equal in number to said third number of generated coefficients, each product formed from a selected one of said input channels multiplied by a selected one of said third number of coefficients, and said third computational unit computes an output channel from a sum of one or more products of said set of products.

20. The apparatus of claim 13 further comprising a user interface unit obtaining, from an operator, a first parameter indicating an output mode, and wherein said first computational unit generates one of said coefficients in response to said first parameter.

21. The apparatus of claim 20 wherein said user interface obtains, from an operator, a second parameter indicating an output mode, and wherein said first computational unit generates one of said coefficients in response to said second parameter.

22. The apparatus of claim 21 wherein said first computational unit generates one of said coefficients in response to said first and second parameters.

* * * * *

UNITED STATES PATENT AND TRADEMARK OFFICE

CERTIFICATE OF CORRECTION

PATENT : 6,005,948
DATED : December 21, 1999
INVENTOR(S) : Shuichi Maeda

It is certified that error appears in the above-identified patent and that said Letters Patent is hereby corrected as shown below:

Column 6, line 17 reads "downmnixing" and should read --downmixing --.

Column 6, line 58 reads "22-28and" and should read--22-28 and--.

Column 7, line 37 reads "acmodeO" and should read--acmode0--.

Column 9, line 42 reads "downimixing" and should read--downmixing--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*